US005303552A

United States Patent [19]

Webb

[11] Patent Number: 5,303,552

[45] Date of Patent: Apr. 19, 1994

[54] COMPRESSED GAS BUOYANCY GENERATOR POWERED BY TEMPERATURE DIFFERENCES IN A FLUID BODY

[76] Inventor: Douglas C. Webb, 769 Palmer Ave., Falmouth, Mass. 02540

[21] Appl. No.: 909,212

[22] Filed: Jul. 6, 1992

[51] Int. Cl.[5] ..... F03C 5/00

[52] U.S. Cl. ..... 60/496; 60/641.7; 114/331

[58] Field of Search ..... 60/496, 641.6, 641.7, 60/673; 114/331

[56] References Cited

U.S. PATENT DOCUMENTS

| | | | |
|---|---|---|---|
| 2,208,149 | 7/1940 | Vernet | 60/527 |
| 2,534,497 | 12/1950 | Albright | 137/157 |
| 2,714,759 | 8/1955 | Von Wagenheim | 29/33 |
| 2,806,376 | 9/1957 | Wood | 73/368.3 |
| 3,179,962 | 4/1965 | Shear et al. | 9/8 |
| 3,256,539 | 6/1966 | Clark | 9/8 |
| 3,257,672 | 6/1966 | Meyer et al. | 9/8 |
| 3,466,866 | 9/1969 | Eschenfeld | 60/22 |
| 3,520,263 | 7/1970 | Berry et al. | 114/16 |
| 3,665,883 | 5/1972 | Sege | 114/331 |
| 3,753,311 | 8/1973 | Boone | 43/43.14 |
| 3,896,622 | 7/1975 | Daniello | 60/641 |
| 3,952,349 | 4/1976 | Erath et al. | 9/8 |
| 4,031,581 | 6/1977 | Baugh | 9/8 |
| 4,170,878 | 10/1979 | Jahnig | 60/641 |
| 4,183,316 | 1/1980 | Bennett | 114/331 |
| 4,233,813 | 11/1980 | Simmons | 60/496 |
| 4,266,500 | 5/1981 | Jurca | 114/333 |
| 4,286,539 | 9/1981 | Pignone | 114/331 |
| 4,364,325 | 12/1982 | Bowditch | 114/331 |

FOREIGN PATENT DOCUMENTS

| | | |
|---|---|---|
| 2260001 | 1/1974 | France . |
| 1096161 | 7/1984 | U.S.S.R. . |

OTHER PUBLICATIONS

Jan. 1, 1989; "Autonomous Lagrangian Circulation Explorer (ALACE)" Pamphlet, Webb Research Corporation; Falmouth, Mass.

*Primary Examiner*—Stephen F. Husar

*Attorney, Agent, or Firm*—Oblon, Spivak, McClelland, Maier & Neustadt

[57] ABSTRACT

A compressed gas buoyancy generator powered by temperature differences in a fluid medium having a thermal gradient which includes a body having an inflatable chamber connected thereto for rendering the body buoyant at a surface of the fluid medium and a mechanism for inflating the inflatable chamber with a gas, the inflating mechanism including a mechanism for inflating the inflatable chamber with the gas by obtaining energy from the thermal gradient within the fluid medium. The inflating mechanism includes a mechanism for absorbing heat at a surface portion of the fluid medium and for converting the absorbed heat at a predetermined depth of the fluid medium into a mechanical work for inflating the inflatable chamber when the body is at the surface of the fluid medium.

7 Claims, 5 Drawing Sheets

COMPRESSED GAS BUOYANCY GENERATOR POWERED BY TEMPERATURE DIFFERENCES IN A FLUID BODY

BACKGROUND OF THE INVENTION

1. Field of the Invention

This application concerns a thermal engine with the capability to store and controllably release energy and which is particularly adaptable to free bodies which move vertically in a fluid medium, typically in the ocean.

2. Discussion of the Background

Bodies are commonly moved vertically through the ocean, for example instruments which measure the properties of the interior of the ocean at one or more depths, and transit to the surface for recovery, radio telemetry of stored data, etc.

The design of such bodies involves two problems. First, the motion from deep in the ocean to the surface and return. The work required is designated as the driving force F times the distance d through the water (i.e., work $=F\times d$), and several approaches to generating the driving force are commonly used. For example, a motor/propeller system or a system of movement of seawater ballast from inside the body to outside, thus changing the density of the body, is known. Also known is a system of transferring oil or other fluids between a reservoir inside the body to a flexible external bladder, thus changing the specific volume of the body. This may include jettisoning of fluid or solid bodies of a density greater or less than a secondary body, or the transfer of gas from a storage reservoir inside the body to a flexible external bladder to ascend, and jettisoning the gas for descending.

For example, the ocean instrument commonly called ALACE (Autonomous Lagrangian Circulation Explorer) uses a electro-hydraulic system as follows. To ascend (i.e. gain buoyancy), oil from an internal reservoir is pumped to a flexible external reservoir via a hydraulic pump powered by an electric motor. To descend, an electrically operated hydraulic valve opens and allows oil to flow from the external to an internal reservoir. Both the motor and valve draw power from a battery pack and are controlled by an electronic controller.

Most of these approaches have been used, and are suitable for providing the driving force to move the body through a column of water.

Once the body reaches the surface of the ocean a second problem is frequently encountered. The body needs a certain buoyancy to expose its antenna, relocation aids, reflectors, etc., and this buoyancy is often greater than can be readily provided by the propulsion system which brought it to the surface.

Stated another way, the body, on arrival at the surface has very little buoyancy, and if disposed in a surface wave field, it will frequently be below the surface.

SUMMARY OF THE INVENTION

The present application concerns this second problem, and an object of the invention is the provision of additional buoyancy at the surface using a dedicated (or separate) buoyancy generator.

This buoyancy generator could be operated with stored energy, i.e., stored compressed gas, irreversible chemical conversion, batteries, etc. This application involves a surface buoyancy engine which derives its energy from the thermal gradient present in much of the world's oceans, that is, where surface water is warmer than deep water, and is not dependent on energy which was stored within the body.

In this invention the body contains a thermal engine which can be used to inflate an external bag or bladder to provide additional buoyancy at the surface and to vent this gas to the interior of the body for descent. The core of the invention is the recharging of the compressed gas reservoir using thermal energy extracted from the fluid medium. To function properly the invention requires a medium which is warmer at the surface than at a predetermined depth. This is true of the temperate and tropical oceans. The present invention is thus for a thermal engine with a specific thermodynamic cycle in which heat flows into the engine from the warm surface water and is then discarded into the cool deep water thereby converting the flow of heat to mechanical work, e.g., the recharging of the gas flowing from below atmospheric pressure to a reservoir above atmospheric pressure. This pressure difference is sufficient to inflate and deflate the buoyancy bag or bladder at the surface.

The present invention recognizes the heat flow principle that when there is a temperature difference between the water and any component in the vehicle, heat will flow from hot to cold. This is an accepted principle of physics. The rate of heat flow depends on many factors, e.g., the flow of water past the hull, thermal conductivity of the metals used, convection and conduction in the water and $NH_3$ gas, etc. Generally, materials with good conductivity are also reasonable choices for vehicle construction. The term "heat" is used in the context of being used to store energy which can then be used to do some kind of work on command. The materials selected for the hull and engine should be strong and resistant to attack by seawater and the engine working fluid. Aluminum and titanium alloys are suitable materials.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
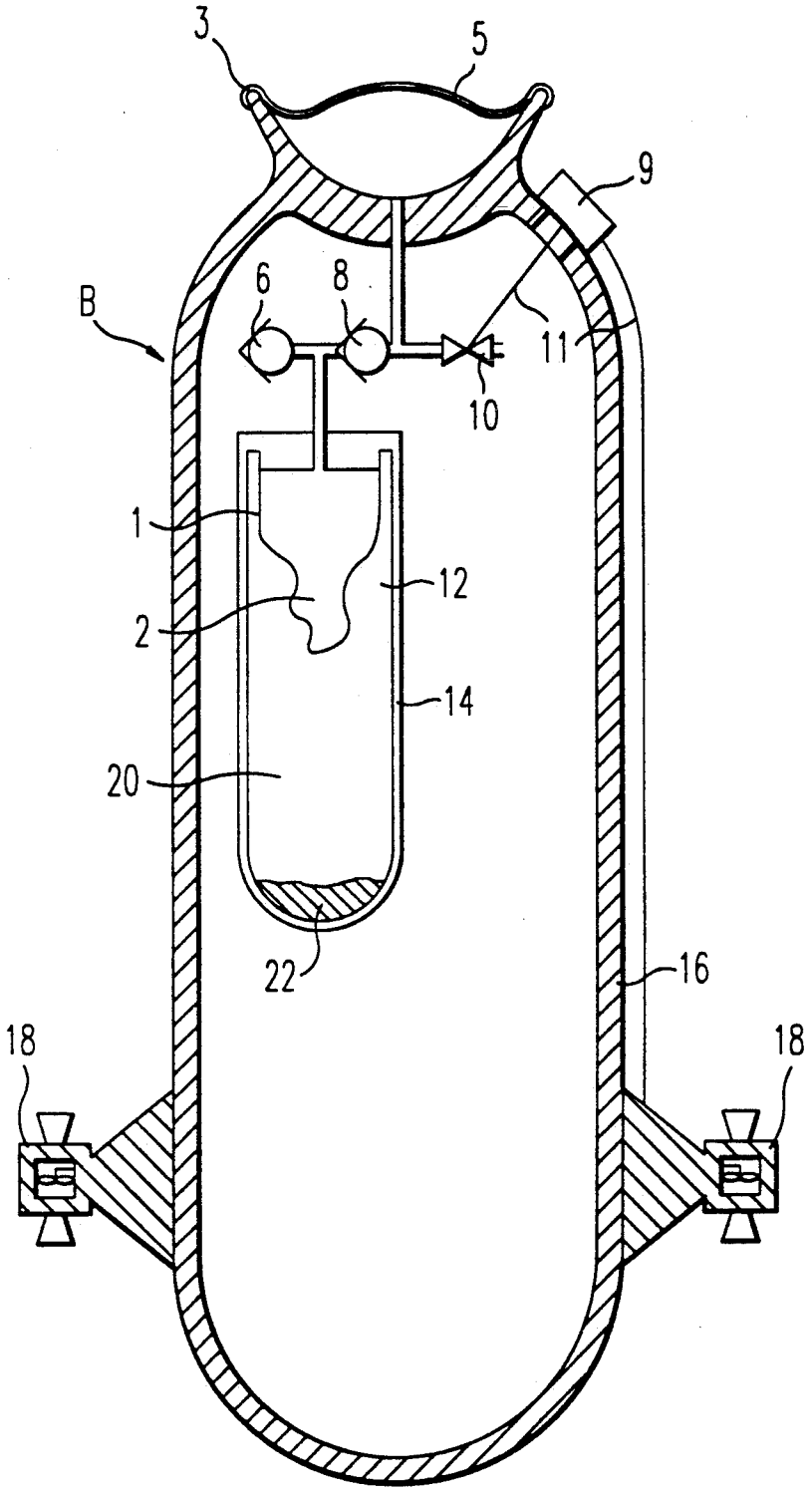
FIGS. 1 and 2 are cross-sectional diagrams of a free body containing the thermal engine of the present invention when operation under warm (i.e., surface) surrounding conditions and water, cold (i.e., deep water) conditions, respectively.
Figure 2:
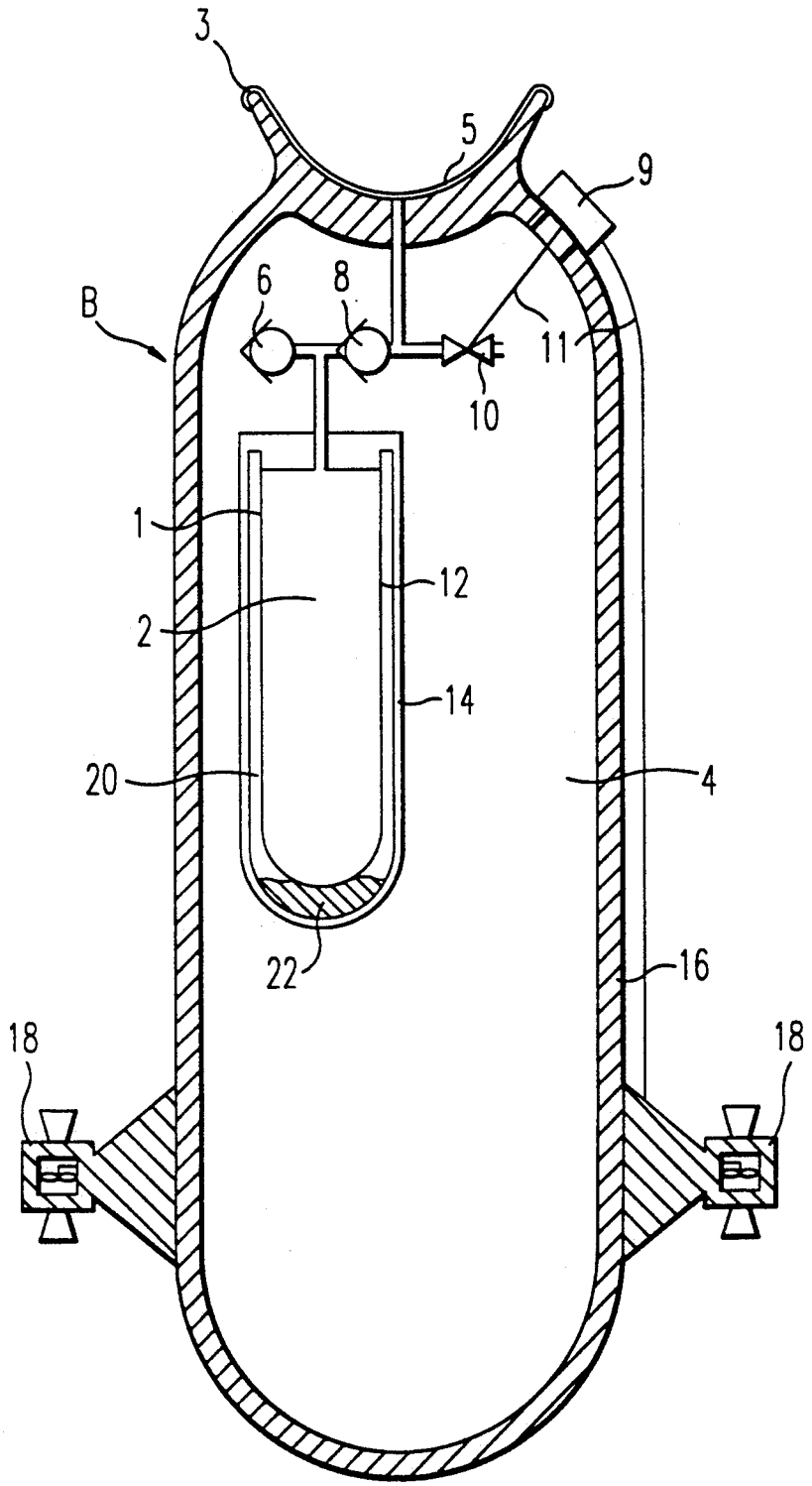

FIGS. 1 and 2 show a body or main vehicle B which includes chambers 1–4, a first flexible bladder 5, check valves 6 and 8, valve 10, a main vehicle microprocessor controller 9, electrical (or possibly hydraulic) lines 11, a second flexible bladder 12, a lightweight sealed container 14 capable of withstanding the pressure of stored gas, and a hull 16 of body B having a propeller-type propulsion mechanism 18 for causing the body to ascend or descend. Valves 6 and 8 may be mechanical valves, if desired, rather than being operated electrically. Ammonia gas or a refrigerant 20 described hereinafter is sealed within chamber 1 by flexible chamber 2 connected to chamber 1 and a solution 22 of water and dissolved ammonia or refrigerant 21 is located at the bottom of chamber 1.

Figure 3:
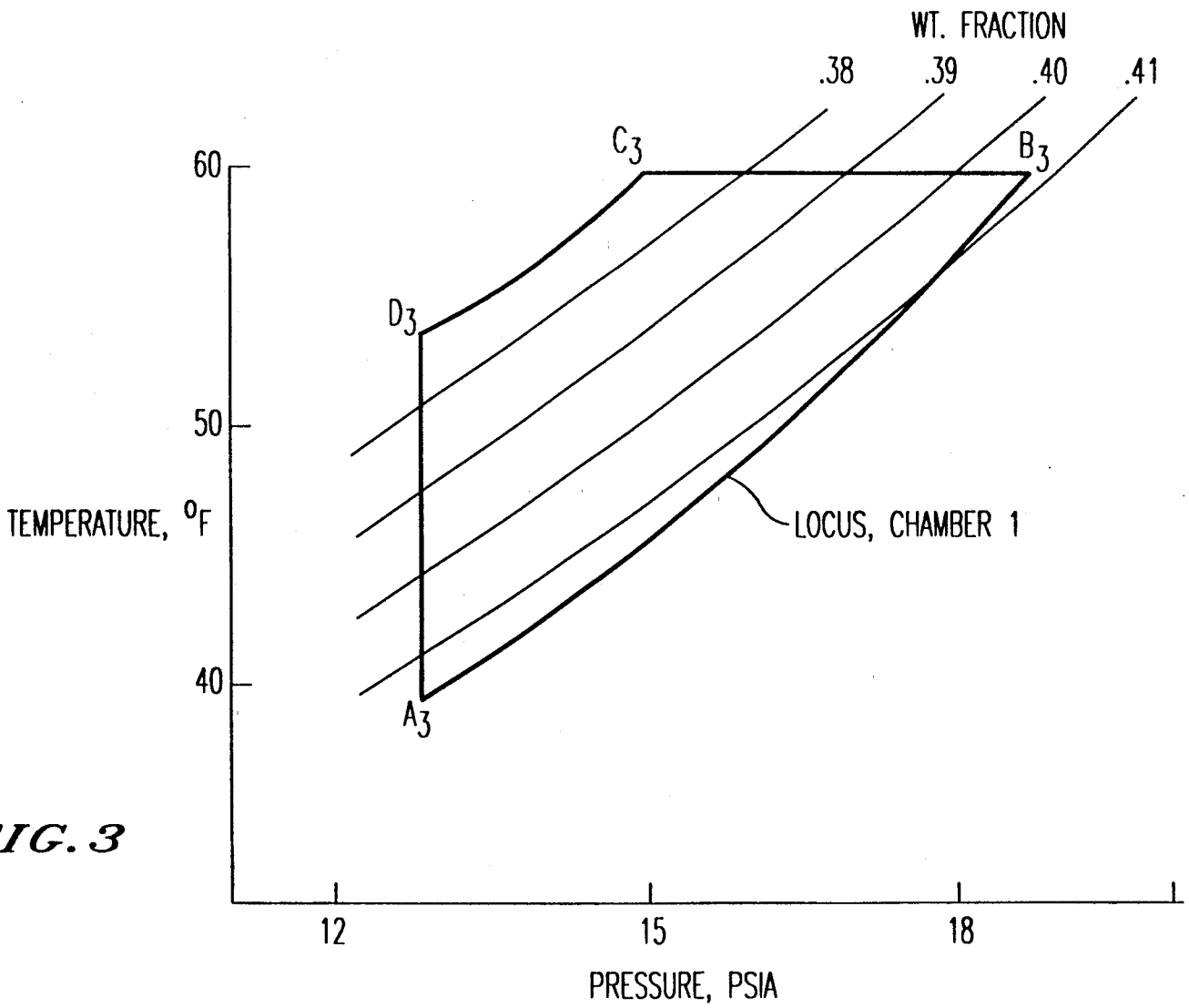
FIG. 3 shows the weight fraction of ammonia in saturated liquid as a function of temperature and pressure.

Superimposed in the fundamental thermodynamic relationship of FIG. 3 is the locus of operation for the ammonia in chamber 1. Some reasonable simplifying assumptions have been made in plotting the operation path. These include the assumption that:

1. check valve cracking pressure is negligible.
2. operation is in thermal equilibrium.
3. chamber 4 is located in the body interior and is much larger than chamber 1 or 2 and, moreover, the pressure in chamber 4 is approximately constantly 13 psi, and hence, does not change when gas is vented into and out of it.

Now tracing the thermodynamic cycle of FIG. 3, starting at point $A_3$, the body is deep and cold, the $NH_3$ pressure is slightly below 13 psi, chamber 2 is filled with nitrogen gas via check valve 6 and valve 10 is closed.

Figure 5:
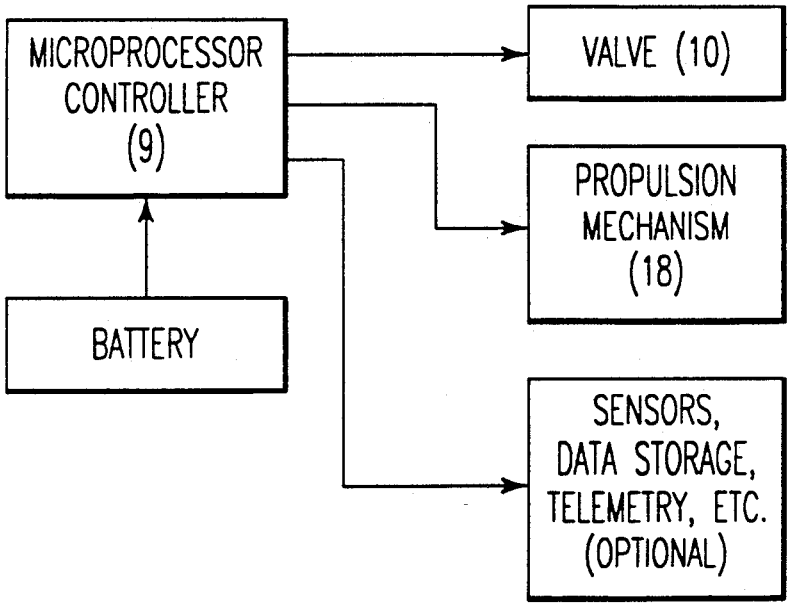
FIG. 5 shows a block diagram illustrating the elements operated by the microprocessor controller.

By a conventional propeller type propulsion mechanism 18 controllable by controller 9 via electrical (or hydraulic) line 11 as shown in FIG. 5, the body B is propelled to the surface of a fluid medium such as the ocean along path $A_3$-$B_3$ of FIG. 3. Propulsion mechanism 18 is used to cause the body to ascend or descend, as needed. As the temperature of the water and body B rises, the vapor pressure of the ammonia increases ($NH_3$ molecules leave solution), the weight fraction in solution decreases slightly and the nitrogen gas in chamber 2 at point $B_3$ is compressed. As the surface is approached the pressure in chambers 1 and 2 is approximately 19 psia.

Once at the surface, operation is along paths $B_3$-$C_3$ in FIG. 3. Atmospheric pressure is applied to the flexible bladder 5 of chamber 3, the nitrogen gas in chamber 2 passes through check valve 8 into chamber 3, chamber 2 becomes reduced in volume, more ammonia comes out of the solution 22 in chamber 1, and heat flows into chamber 1 until equilibrium is reached at atmospheric pressure and surface temperature. The volume of chamber 3 increases as the nitrogen gas flows in, increasing displacement and buoyancy of the body B.

To initiate a descent along path $C_3$-$D_3$ in FIG. 3, the main vehicle controller 9 is electrically (or hydraulically) operated to open valve 10 via a signal along electrical (or hydraulical) line 11, and chamber 3 empties into chamber 4, which is below atmospheric pressure. Initially, there is no change in chambers 1 and 2; however, as the body descends, propelled by the propulsion mechanism 18, the temperature falls, ammonia re-enters solution, until at point $D_3$ in FIG. 3 the pressure in chamber 1 is below the 13 psia level in chamber 4 and nitrogen gas enters chamber 2 through check valve 6.

Over path $D_3$ to $A_3$ in FIG. 3, further cooling occurs, heat flows from chamber 1 to the surrounding seawater, ammonia goes into solution, the weight fraction increases, and chamber 2 is filled with nitrogen gas from chamber 4 via check valve 6. When equilibrium is reached at point $A_3$ in FIG. 3, the cycle may be repeated. The arrangement of FIGS. 1 and 2 could also be used with a pure working fluid, rather than a solution.

Figure 4:
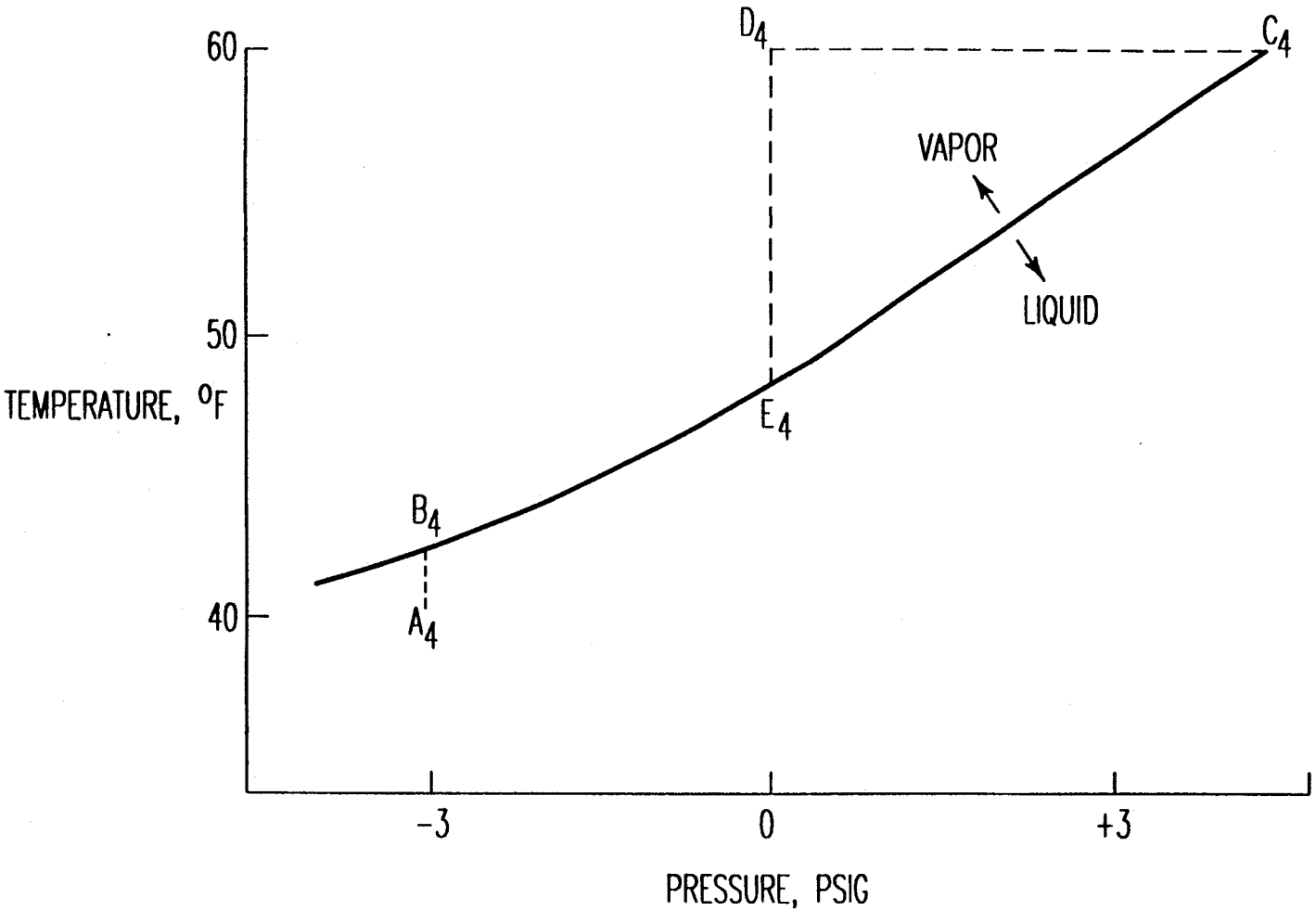
FIG. 4 shows saturation vapor pressure vs. temperature values when using refrigerant R21.

FIG. 4 shows the saturation vapor pressure vs. temperature values for $CHCl_2$, F, dichclorofluoromethane (known as Refrigerant 21 (i.e. "R21") commercially available from PCR of Gainesville, Fla.). Using the same assumptions as used from FIG. 2, and substituting in FIG. 1 the R21 for ammonia and water, the thermodynamic cycle in chamber 1 is as follows:

Starting at point $A_4$, the body is deep and cold, the R21 is completely condensed, and chamber 2 is filled with nitrogen gas via check valve 6, valve 10 being closed under command of controller 9. By propulsion mechanism 18 the body is propelled to the surface along path $A_4$-$B_4$-$C_4$. The R21 rises in temperature but does not evaporate over path $A_4$-$B_4$. Over path $B_4$-$C_4$ the R21 evaporates. The temperature continues rising, and the nitrogen gas in chamber 2 is compressed but cannot escape from this chamber.

As the surface is approached the pressure in chambers 1 and 2 is approximately +4 psig. Once at the surface, atmospheric pressure (0 psig) is applied to bladder 5 of chamber 3, the R21 continues to evaporate, and the nitrogen gas in chamber 2 flows to chamber 3 via opening of check valve 8 by controller 9. The nitrogen gas in chamber 3 provides the additional displacement, and therefore assures buoyancy at the surface.

To initiate a descent along path $D_4$-$E_4$, the controller 9 opens valve 10 via line 11 and chamber 3 empties into chamber 4, which is below atmospheric pressure. Initially there is no change in chambers 1 and 2, however, as the body B descends propelled by propulsion mechanism 18, the temperature falls, the R21 vapor cools and at point $D_4$ begins to condense.

Condensation continues over path $E_4$-$B_4$. At point $B_4$ the R21 pressure is equal to the pressure of chamber 4, and nitrogen gas flows from chamber 4 to chamber 1 via check valve 6 opened via controller 9 and line 11.

Over path $B_4$-$A_4$, the temperature continues to drop, the R21 is completely condensed (i.e., is all liquid), and chamber 2 is completely filled with nitrogen gas. Chambers 1, 2 and 4 are all at −3 psig.

The above description uses the preferred working fluids of $NH_3$ (ammonia) dissolved in water, and R21. There are, however, many other materials that can be used.

The operation cycle is controlled very simply. The surface engine of the present invention is a subsystem under the control of controller 9. When the surface engine receives a command to descend, electrically operated valve 10 opens, chamber 3 contracts, and the buoyancy of the body decreases.

When the body begins an ascent, valve 10 is closed.

Valve 10 is not subject to large differential pressures, and a very large choice of suitable commercial valves exist. Operation of valve 10 is as follows:

Operation Table

| Signal from main vehicle controller 9 | Voltage applied to valve 10 | Valve 10 status |
|---|---|---|
| ascend | 0 V | closed |
| descend | +5 | open |

One can visualize many non-oceanic applications of the present invention. For example, there are many parts of the world where there is daily temperature recycling from warm during the day to cool at night. A simple engine able to store energy to be used on command is useful. This would be broadly analogous to a solar collector used to store energy in batteries for use on demand. However, there are many applications where a reservoir of gas above atmospheric pressure may be a more suitable form of stored energy, e.g., operating valves, solar shutters, etc.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A compressed gas buoyancy generator powered by temperature differences in a fluid medium having a thermal gradient, which comprises:

a body having an inflatable chamber connected thereto for rendering said body buoyant at a surface portion of said fluid medium;

a gas source;

an inflater connected to said body and in communication with said gas source for inflating said inflatable chamber with gas from said gas source by obtaining energy from said thermal gradient within said fluid medium wherein said inflator comprises an apparatus for absorbing heat at a surface portion of said fluid medium and for converting the absorbed heat at a predetermined depth of said fluid medium into mechanical work for inflating said inflatable chamber when said body is at the surface portion of the fluid medium.

2. A buoyancy generator as claimed in claim 1, wherein said inflater comprises a first and second interior chamber, said first interior chamber having a compressed gas sealed therein by said second interior chamber and a first valve for communicating the interior of said second chamber with said inflatable chamber.

3. A buoyancy generator as claimed in claim 2, which comprises a third interior chamber located within said body and a second valve for venting said gas from said inflatable chamber to said third interior chamber so as to cause said body to descend in said fluid medium.

4. A buoyancy generator as claimed in claim 3, wherein said first and second interior chambers are positioned within said third interior chamber and wherein second and third interior chambers are in communication with one another.

5. A buoyancy generator as claimed in claim 1, wherein said inflater for inflating and deflating said inflatable chamber comprises a first and second interior chamber, said first interior chamber having a compressed gas sealed therein by said second interior chamber and a first valve for communicating the interior of said second chamber with said inflatable chamber.

6. A buoyancy generator as claimed in claim 5, which comprises a third chamber located within the interior of said body and a second valve for venting said gas from said inflatable chamber to said third chamber so as to cause said body to descend in said fluid medium.

7. A buoyancy generator as claimed in claim 6, wherein said first and second interior chambers are positioned within said third interior chamber and said second and third interior chambers are in communication with one another.

* * * * *